US005281192A

United States Patent [19]

Nelson

[11] Patent Number: 5,281,192

[45] Date of Patent: Jan. 25, 1994

[54] PORTABLE FOREARM AND HAND EXERCISE DEVICE

[76] Inventor: Thomas F. Nelson, 16555 Mary Cliff La., Brookfield, Wis. 53005

[21] Appl. No.: 47,251

[22] Filed: Apr. 14, 1993

Related U.S. Application Data

[63] Continuation of Ser. No. 879,717, May 6, 1992, abandoned, which is a continuation of Ser. No. 394,964, Aug. 17, 1989, abandoned.

[51] Int. Cl.[5] ..... A63B 21/06

[52] U.S. Cl. ..... 482/93; 482/105; 482/108; 482/109

[58] Field of Search ..... 482/44, 45, 46, 49, 482/50, 93, 105, 106, 107, 108, 109, 139

[56] References Cited

U.S. PATENT DOCUMENTS

| | | | |
|---|---|---|---|
| 3,180,641 | 4/1965 | Shane | 272/119 |
| 4,109,908 | 8/1978 | Pugh et al. | 272/119 |
| 4,310,154 | 1/1982 | Kauffman | 482/46 |
| 4,345,756 | 8/1982 | Hoagland | 272/117 |
| 4,377,282 | 3/1983 | Hayes | 272/124 |
| 4,484,740 | 11/1984 | Green | 272/122 X |
| 4,537,394 | 8/1985 | Golinsky et al. | 272/117 |
| 4,575,074 | 3/1986 | Damratoski | 272/119 |
| 4,589,655 | 5/1986 | Ammon | 482/46 |
| 4,607,840 | 8/1986 | Harper | 272/122 X |
| 4,664,373 | 5/1987 | Hait | 272/117 |
| 4,714,247 | 12/1987 | Gerstung | 272/119 X |
| 4,809,975 | 3/1989 | Lee | 482/109 X |
| 4,943,052 | 7/1990 | Powers | 482/109 X |

FOREIGN PATENT DOCUMENTS

| | | | |
|---|---|---|---|
| 503931 | 3/1920 | France | 272/124 |
| 446726 | 5/1936 | United Kingdom | 482/109 |

*Primary Examiner*—Robert Bahr

*Attorney, Agent, or Firm*—Michael, Best & Friedrich

[57] ABSTRACT

The portable forearm and hand exercise device includes a generally U-shaped member having an arcuate midsection and a pair of rearwardly extending legs spaced far enough apart to accommodate the anticipated widest exerciser's hand, a handle extending transversely between and adjustably mounted on the legs, a forwardly extending elongated rod connected to and offset from the center of the midsection, one or more small weights which are carried by the rod and can be secured to the rod at various locations and a flexible, adjustable strap which supports an exerciser's hand below the wrist for some exercises. When an exercise requires the fingers to rest on the arcuate midsection, the handle can be moved to a position most comfortable for the individual exerciser.

11 Claims, 1 Drawing Sheet

PORTABLE FOREARM AND HAND EXERCISE DEVICE

This application is a continuation of Ser. No. 879,717, filed May 6, 1992, now abandoned which in turn is a continuation of Ser. No. 394,964 filed Aug. 17, 1989, now abandoned.

This invention relates to portable exercise devices and, more particularly, to portable devices for exercising forearms and hands.

For therapeutic purposes and performance enhancement in certain activities, it may be desirable to train forearm and hand muscles, particularly muscles associated with wrist and finger movements. For example, strong fingers and grip are highly desirable for rock climbing.

Applicant is unaware of any practical portable device which can be conveniently used to exercise a wide variety of muscles associated with wrist and finger movement.

SUMMARY OF THE INVENTION

A principal object of the invention is to provide a simple, portable device for exercising the forearm and hand.

Another object of the invention is to provide such a device which can be conveniently adjusted to vary the exercise level.

A further object of the invention is to provide such a device which can be used with either hand and conveniently adjusted to vary the primary muscles being exercised.

Other objects, aspects and advantages of the invention will become apparent to those skilled in the art upon reviewing the following detailed description, the drawing and the appended claims.

The invention provides a portable forearm and hand exercising device including a generally U-shaped member having an arcuate midsection and a pair of legs extending rearwardly from the midsection and laterally spaced far enough apart to accommodate the largest anticipated width of an exerciser's hand, a handle extending transversely between and mounted on the legs, an elongated rod connected to and extending forwardly from the midsection and at least one, and preferably a plurality of, small weights adapted to be carried by and selectively secured to the rod at various locations along the length of the rod. The rod preferably is offset from the center of the midsection so that, when the handle is held with the rod closest to the thumb side of the hand, the weight exerted by the rod and weight(s) is concentrated over the normally stronger portion of the hand. The handle preferably is adjustably mounted on the legs so that, when an exercise requires the fingers to rest on the arcuate midsection, the handle can be moved to a position most appropriate for the individual exerciser.

The device can include a flexible strap extending transversely between and mounted on the legs at a location rearwardly of the handle. The strap is adjustable so that is can engage either the front or back of the exerciser's hand below the wrist joint and accommodate different sized hands.

DETAILED DESCRIPTION

Figure 1:
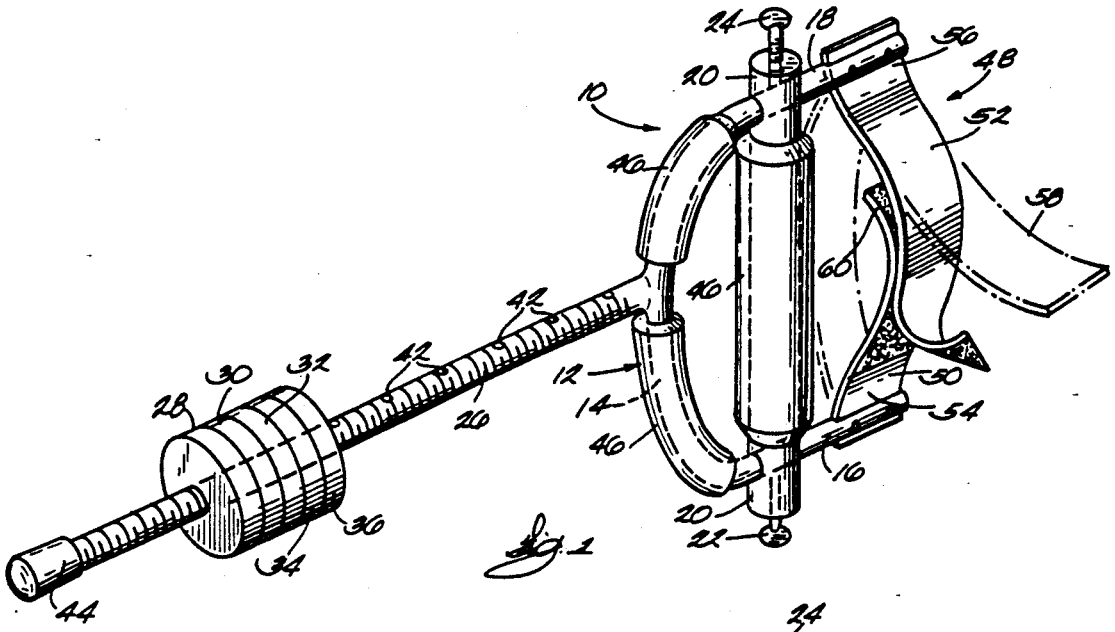
FIG. 1 is a perspective view of a portable forearm and hand exercise device embodying the invention.

The portable forearm and hand exercise device 10 illustrated in the drawing comprises a generally U-shaped member 12 including an arcuate midsection 14 and a pair of legs 16 and 18 extending rearwardly from the midsection 14 and laterally spaced far enough apart to accommodate therebetween the largest anticipated width of an exerciser's hand. A handle 20 extends transversely between and is slidably mounted on the legs 16 and 18 for movement relative to the midsection 14 so the distance between the handle 20 and the midsection 14 can be adjusted to accommodate different hand sizes and for different exercises as explained below.

Means are provided for selectively securing the handle 20 to the legs 16 and 18 at various locations on the legs. In the specific embodiment illustrated, such means comprises a pair of set screws 22 and 24 which are threaded into the opposite ends of the handle 18 and can be tightened into engagement with the respective legs 16 and 18.

An elongated rod 20 is connected to the midsection 14 and extends forwardly therefrom in a direction opposite to the legs 16 and 18. The device 10 includes at least one, and preferably a plurality of, small circular weights 28, 30, 32, 34 and 36 which are removably carried on the rod 26. Means are provided for securing the weights 28, 30, 32, 34 and 36 at various locations on the rod 26 to vary the length of the effective movement arm between the weights and the handle 20 and the midsection 14 and thereby vary the leverage required to lift the device during exercise. In the specific embodiment illustrated, the rod 26 is threaded along substantially the entire length and the weights are in the form of circular disks. Each of the end weights 28 and 36 have a central threaded aperture 38 and is threaded onto the rod and each of the other weights 30, 32 and 34 has a central, unthreaded aperture 40 which has an inside diameter which is slightly larger than the outside diameter of the rod 26 so that they can be slipped onto the rod 26.

The end weight 36 is threaded onto the rod to a desired location, the weights 30, 32 and 34 are slipped onto the rod and the other end weight 28 threaded on the rod 26 to tighten or sandwich the weights 30, 32 and 34 against the end weight 36 and secure them in a position. The weights can be conveniently moved in opposite directions along the rod 26 by rotating the appropriate end weight 28 or 36 in either the clockwise or counterclockwise direction to move it to the desired location and then rotating the other end weight in the same direction until the intermediate weights are sandwiched between the two end weights. If only one or two weights are desired, only the end weights 28 and 36 are used. Other weights can be added to progressively increase the exercise resistance. While the size of the weights can vary, they preferably are in the order of about 8 ounces.

The rod 26 has a plurality of longitudinally spaced, circular indentations 42, each including a number or letter which can be used as a reference for locating the weights on the rod 26.

Figure 2:
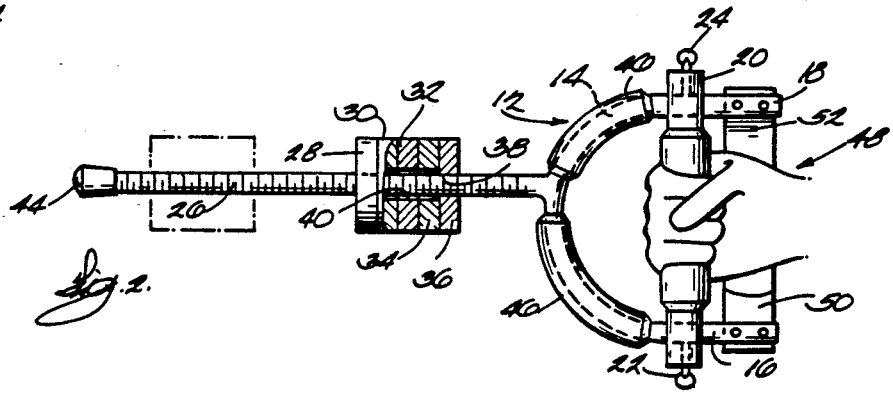
FIG. 2 is a partially sectioned, top view of the device illustrated in FIG. 1, shown held in the right hand of an exerciser for a flexion exercise.
Figure 3:
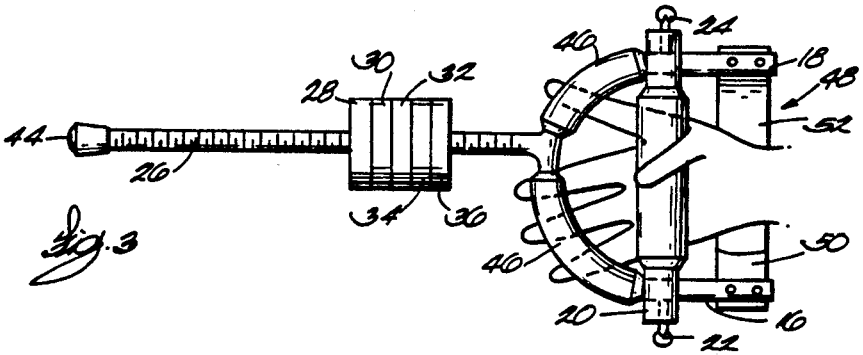
FIG. 3 is a top plan view of the device illustrated in FIG. 1, shown held in the right hand of an exerciser for a digital flexion exercise.

As best shown in FIGS. 2 and 3, the rod 26 is connected to the midsection 14 at a point offset from the center of the midsection 14 so that, when the handle 20 is held with the rod 26 closest to the thumb side, the downward force exerted by the rod 26 and the weights is concentrated over the normally stronger portion of the hand. The length of the two bones of the forearm (ulna and radius) normally are such that the hand may flex or hinge in an arc. This off-center placement of the rod 26 assists in balancing the movement of the hand during exercising.

A rubber bumper 44 is removably mounted on the end of the rod 26 for protection. It is removed for installation and removal of weights. The handle 20 and portions of the midsection 14 on the opposite sides of the rod 26 preferably are covered with a padded material 46, such as a soft rubber or the like, for comfort and to minimize slippage in the exerciser's hand during use.

A flexible strap 48 extending transversely between and mounted on the legs 16 and 18 at a location rearwardly of the handle 20 is provided to distribute force over a larger area of the hand, particularly the back (dorsum), below the wrist joint during certain exercises. The strap 48 has two separate parts 50 and 52 including respective outer ends 54 and 56 suitably affixed to respective legs 16 and 18 and overlapping respective inner ends 58 and 60. The strap parts 50 and 52 are arranged so that the length of the strap 48 can be adjusted to accommodate different size hands, can engage either the front or back of the hand and can be pulled completely away from the hand for some exercises. In the specific construction illustrated (FIG. 1), strips of meshing Velcro material is sewn or otherwise suitably secured to the underside of the strap part 52 and the topside of the strap part 50.

Once the strap 48 has been adjusted for either the right hand or the left hand, it does not have to be readjusted when the device 10 is switched to the other hand for the same exercise movement. To change from one hand to the other, the device 10 is turned over so that the rod 16 is closest to the thumb side of the hand to be exercised and the strap 48, with the parts 50 and 52 connected, is flipped over to the other side of the handle 20 as shown by dashed lines in FIG. 1.

Figure 4:
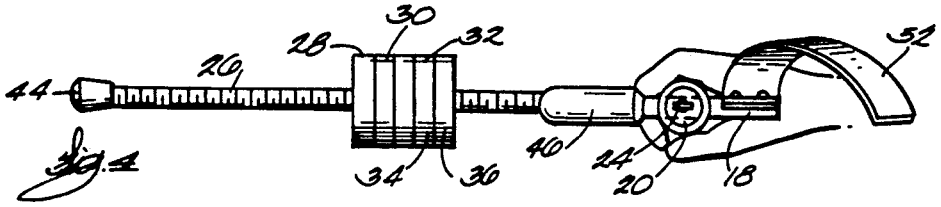
FIG. 4 is a side view of the device illustrated in FIG. 1, shown held in the right hand of an exerciser with the strap parts unattached for a supination exercise.

The device 10 can be used in a number of different ways to exercise various forearm, hand and finger muscles. Use of the device for three different type exercises is illustrated in FIGS. 2–4. FIG. 2 illustrates a flexion exercise in which the handle 20 is grasped with the right hand in the supine position (palm up) with the thumb side closest to the rod 26. The strap 48 is adjusted to fit against the dorsal (back) side of the hand so that a slight resistance to weight is felt as the device 10 is moved between a lowered position (rod about minus 90° from horizontal) and a raised position (rod about plus 45° from horizontal) with the forearm stationary and generally horizontal. The dorsum of the forearm can be supported on the exerciser's knee while sitting on a chair or the like to assist in keeping the forearm stationary.

FIG. 3 illustrates a digital flexion exercise or isometric exercise of digital and palmar muscles and isotonic exercise of the wrist flexor muscles. The hand and forearm positions used are the same as that for the exercise illustrated in FIG. 2, except that the distal finger pads rest on the underside of the padded portions of the midsection 14. The index finger is positioned separately on the thumb side of the midsection 14. The handle 20 is moved to a position where it fits comfortably in the saddle between the index finger and the thumb and the strap 48 does not interfere with wrist movement. The device 10 is moved between lowered and raised positions as described above.

FIG. 4 illustrates a supination exercise. The strap parts 50 and 52 are unfastened and pushed away so that they will not interfere with the exerciser's grip. As viewed in FIG. 4, the handle 20 is grasped with the right hand in the pronated position (palm down) and the thumb side closest to the rod. With the elbow supported on the exerciser's knee while sitting in a chair or on a chair or the like, the wrist locked, and the rod 26 held at about 90° to the forearm throughout the exercise, the forearm is rotated from a pronated (palm down) to a supine (palm up) position.

From the above description, it can be seen that the portable forearm and hand exercise device of the invention is compact and simply constructed, can be conveniently used to exercise different groups of forearm and hand muscles, can be conveniently adjusted to progressively increase the exercise level, can be conveniently adjusted to accommodate different size hands and, when the strap is used, can be changed from one hand to the other without requiring readjustment of the strap.

From the foregoing description, one skilled in the art can easily ascertain the essential characteristics of the invention and, without departing from the spirit and scope thereof, make various changes and modifications to adapt it to various usages.

I claim:

1. A portable forearm and hand exercise device comprising a generally U-shaped member including an arcuate midsection having a midpoint and further including a pair of legs extending rearwardly from said midsection and sufficiently laterally spaced apart to accommodate an exerciser's hand therebetween;

a handle extending transversely between and mounted on said legs for movement relative to said midsection so that the distance between said handle and said midsection can be adjusted to facilitate contact of the distal finger pads of different size hands with said midsection;

means for selectively securing said handle at different locations on said legs;

an elongated rod connected to said midsection and extending forwardly therefrom in a direction opposite to said legs, said rod carrying at least one small weight and being connected to said midsection at a location offset from said midpoint such that, when said handle is held with said rod closest to the thumb side of the hand, the weight exerted by said rod and said weight is concentrated over the normally stronger part of the hand;

means for selectively securing said weight at different locations on said rod; and a flexible strap extending between and mounted on said legs at a location rearwardly of said handle, said strap being adapted to engage either the front or back of either the left or the right hand below the wrist joint when said device is held in the respective hand and being adjustable to accommodate different size hands.

2. A device according to claim 1 wherein said strap includes two separate parts, each having an inner end mounted on a respective leg and an inner end; and means for removably fastening said inner ends of said strap parts together in overlapping relationship to vary the length of said strap.

3. A device according to claim 2 wherein said handle and portions of said midsection on opposite sides of said rod are covered with a padded material.

4. A device according to claim 3 wherein said rod is threaded along a substantial portion of the length thereof; and said device includes at least three of said weights, with at least two of said weights having a threaded central aperture for threading onto said rod and at least one of said weights having a central opening for slidably mounting on said rod between two of said threaded weights.

5. A portable forearm and hand exercise device comprising a generally U-shaped member having an arcuate midsection and a pair of legs extending rearwardly from said midsection and laterally spaced far enough apart to accommodate an exerciser's hand therebetween;

a handle extending transversely between said legs and having opposed first and second ends slidably mounted on a respective one of said legs for movement of said handle both relative to said legs and relative to said midsection whereby the distance between said handle and said midsection can be adjusted, said legs extending rearwardly a short distance from said handle and terminating at a location where the user, with said handle located in the palm of his or her hand, can freely move his or her hand relative to the forearm at the wrist joint without interference from said legs or said handle;

means carried by said handle for selectively securing said handle at different locations on said legs;

an elongated rod connected to said midsection and extending forwardly therefrom in a direction opposite to said legs;

at least one small weight adapted to be carried on said rod; and means for selectively securing said weight on said rod at different locations along the length of said rod.

6. A device according to claim 5 wherein said handle and portions of said midsection on opposite sides of said rod are covered with a padded material.

7. A device according to claim 5 wherein said rod is threaded along a substantial portion of the length thereof; and said weight includes a central threaded aperture for threading onto said rod.

8. A device according to claim 7 including at least a pair of said threaded weights; and at least one other weight which has a central aperture for slidably mounting said other weight on sad rod between said pair of threaded weights.

9. A device according to claim 5 wherein said midsection has a midpoint; and said rod is connected to said midsection at a location offset from said midpoint such that, when said handle is held with said rod closest to the thumb side of the hand, the weight exerted by said rod and said weight is concentrated over the normally stronger portion of the hand.

10. A device according to claim 5 including a flexible strap extending transversely between and mounted on said legs at a location rearwardly of said handle, said strap being adjustable to engage either the front or back of the left or the right hand below the wrist joint and distribute force over a large area of the hand when said device is held in the respective hand and to accommodate different size hands.

11. A device according to claim 10 wherein said strap includes two separate parts, each having an outer end mounted on a respective leg and an inner end; and means for removably fastening said inner ends of said strap together and varying the length of said strap.

* * * * *

UNITED STATES PATENT AND TRADEMARK OFFICE

CERTIFICATE OF CORRECTION

PATENT NO. : 5,281,192

DATED : January 25, 1994

INVENTOR(S) : Thomas F. Nelson

It is certified that error appears in the above-identified patent and that said Letters Patent is hereby corrected as shown below:

Column 6, line 20, the word "sad" should read ---said---.

Signed and Sealed this

Fourteenth Day of June, 1994

Bruce Lehman

*Attest:*

BRUCE LEHMAN

*Attesting Officer*

*Commissioner of Patents and Trademarks*